US005435247A

United States Patent [19]

Giori et al.

[11] Patent Number: 5,435,247

[45] Date of Patent: Jul. 25, 1995

[54] PRINTING PLATE WITH RAISED ETCHED IMAGE

[75] Inventors: Fausto Giori; Gianfranco Foresti, both of Lausanne, Switzerland

[73] Assignee: De La Rue Giori S.A., Lausanne, Switzerland

[21] Appl. No.: 207,755

[22] Filed: Mar. 8, 1994

[30] Foreign Application Priority Data

Apr. 5, 1993 [CH] Switzerland ..... 1041/93

[51] Int. Cl.[6] ..... B41N 1/06

[52] U.S. Cl. ..... 101/395; 101/401

[58] Field of Search ..... 101/395, 397, 399, 401, 101/401.1

[56] References Cited

U.S. PATENT DOCUMENTS

| | | | |
|---|---|---|---|
| 1,838,218 | 12/1931 | Durham | 101/401.1 |
| 1,950,684 | 3/1934 | Mark | 101/466 |
| 2,108,822 | 2/1938 | Lippincott | 101/395 |
| 2,638,050 | 5/1953 | King | 101/401.2 |
| 2,789,500 | 4/1957 | Reilly | 101/401.1 |
| 3,558,290 | 1/1971 | Baier et al. | 101/395 |
| 3,891,443 | 6/1975 | Halpern et al. | 101/395 |
| 4,152,986 | 5/1979 | Dadowski et al. | 101/395 |
| 4,283,484 | 8/1981 | Fairhead et al. | 101/401.1 |
| 5,171,363 | 12/1992 | Phillips et al. | 106/20 R |

FOREIGN PATENT DOCUMENTS

| | | |
|---|---|---|
| 2048000 | 4/1972 | Germany . |
| 432716 | 8/1935 | United Kingdom . |
| 866070 | 4/1961 | United Kingdom . |

*Primary Examiner*—Edgar S. Burr
*Assistant Examiner*—Stephen R. Funk
*Attorney, Agent, or Firm*—Kane, Dalsimer, Sullivan, Kurucz, Levy, Eisele and Richard

[57] ABSTRACT

The relief printing part (2) of the printing plate, which is intended to be inked over its entire surface, includes at least one etched recessed pattern (4) intended to be filled with the same ink as that serving for the inking of the relief printing part. The relief printing part preferably has a grainy structure composed of evenly distributed screen dots.

9 Claims, 1 Drawing Sheet

PRINTING PLATE WITH RAISED ETCHED IMAGE

FIELD OF THE INVENTION

The invention relates to a printing plate having at least one relief printing part intended to be inked over its entire surface and to the image obtained by this plate.

PRIOR ART

During the manufacture of security papers, in particular banknotes, it is known to use, on at least one area of the note, security inks, especially optically variable inks known under the abbreviation OVI which have the special feature of changing color with the angle of sight. In order for the optical effect to be able to be obtained, it is necessary for the ink layer deposited on the paper to have a sufficient thickness. However, these inks, available on the market, have the drawback of being very expensive, and this is why they are not very widely used.

It has already been proposed to use these inks either in the intaglio printing process or in the serigraphy printing process. However, both processes have drawbacks. The use of the intaglio process is too expensive as there is a significant loss of ink when the plate is wiped. The use of an expensive process with an expensive ink is an obstacle to the use of this type of security means.

Serigraphy involves, on the one hand, a very slow printing process and, on the other hand, this process does not enable fine lines or guilloches, but only a uniform surface, to be printed. These inked areas which have any desired geometrical shape, star, rectangle, circle, may easily be counterfeited and therefore do not provide sufficient security.

The object of the invention is to create a printing plate for the production of a security pattern which is difficult to falsify when manufacturing security papers, in particular banknotes, and especially making it possible to use, without loss, special inks, in particular optically variable inks, for the printing of this security pattern.

SUMMARY OF THE INVENTION

For this purpose, the printing plate according to the invention is one in which the relief printing part includes at least one etched recessed pattern intended to be filled with the same ink as that serving for the inking of the relief printing part.

In this way, a printed security pattern is obtained, especially on a banknote, having any, for example square, rectangular or circular, configuration, and composed of the combination of a uniform background of a given color and, on this background, a pattern with ink relief, of the same color, by virtue of the etched recessed pattern on the printing part. This relief pattern has the appearance of intaglio printing but is inked and printed according to letterpress printing, and therefore without wiping, which is less complicated than the intaglio printing process and more economical.

Another advantage resulting from this printing plate is that, in the case in which very expensive special inks are used, it enables this ink to be used in a very much more economical manner than hitherto.

The image obtained by the printing plate according to the invention is characterized in that it has a uniform inking pattern corresponding to the contour of the relief printing part and, superimposed on said uniform inking pattern, a raised pattern, of the same ink and of the same color, corresponding to the recessed pattern.

BRIEF DESCRIPTION OF THE DRAWINGS

The invention will be described with the aid of the appended drawings in which.

DESCRIPTION OF THE PREFERRED EMBODIMENT(S)

Figure 1:
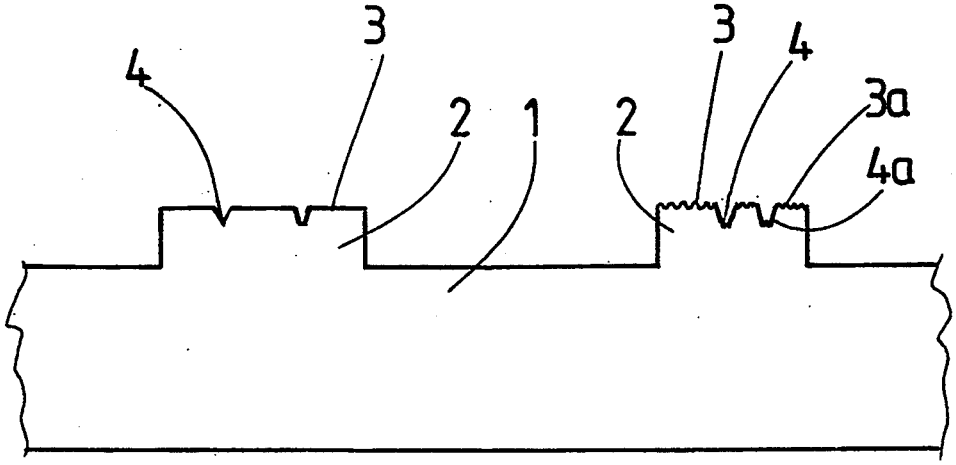
FIG. 1 represents diagrammatically, in section, a segment of a printing plate according to the invention, the dimensions of the various reliefs of this plate being exaggerated on purpose for the sake of better understanding.
Figure 2:
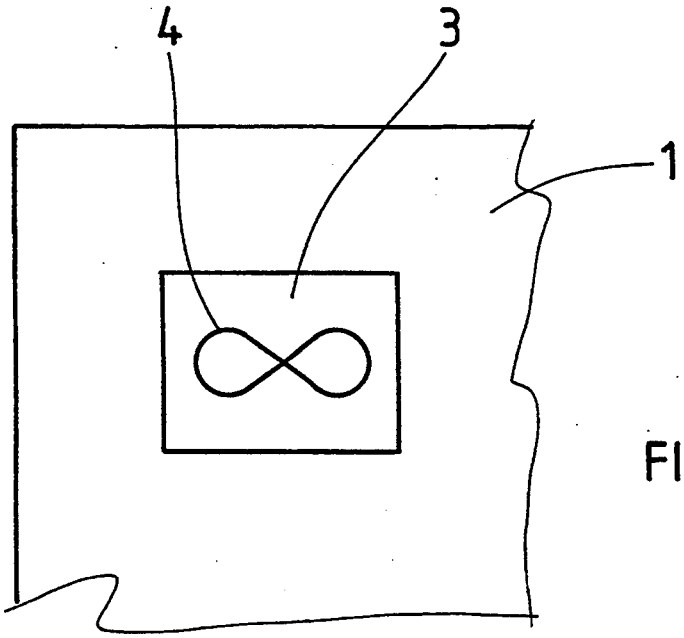
FIG. 2 represents a partial plan view of this plate.

The segment of the printing plate 1 represented in FIGS. 1 and 2 includes, in the example in question, two relief parts 2, the surface 3 of which is printing. An etched pattern composed of cuts 4, as on an intaglio plate, is provided in this printing surface 3. According to FIG. 2, this etched pattern has the shape of a horizontal eight and the result will be a corresponding printed image, with ink relief, on the sheet.

In order to increase the security of the pattern, it is also possible to design the surface of the printing part 3 to have a grainy structure 3a composed of evenly distributed screen dots, as illustrated on the right-hand side of FIG. 1. The bottom 4a of the cuts 4 may also have a line screen.

The height of the relief parts 2 can vary between 200 and 1000 μm. The depressions of the grainy structure 3a preferably have a depth lying between 5 and 30 μm and the cuts 4 of the etched pattern are deeper than the depressions of the grainy structure, their depth lying, for example, between 20 and 80 μm. Of course, the depth of the cuts has to be greater than the depth of the depressions of the grainy structure. In the case where the depressions of the grainy structure have a depth in the vicinity of 30 μm, the depth of the cuts is obviously greater than 30 μm.

The inking of such a printing plate according to the invention is carried out uniformly over the entire surface with a conventional inking roller, as used for letterpress printing, or else with an inking roller as used for intaglio printing, so that the entire surface 3 of the relief printing part is covered with ink and that the cuts of the etched pattern are well filled, but without subsequent wiping. The ink thickness on the relief printing parts can preferably vary between 7 μm and 30 μm.

The manufacture of such printing plates may preferably be carried out as follows: starting from a metal plate, for example a brass plate, the first step is to produce the etched pattern composed of cuts 4 of varying depth. The next step is to define the configuration of the security patterns which have, for example, a rectangular contour, and the entire material is removed from the plate outside these configurations which have been defined, so that only the desired relief parts 2 are left.

In the case where the surface of the security pattern is grainy, the first step is to produce the grainy screen on the plate, this screen preferably being produced only on the regions which will subsequently form the relief parts, and next, in this screen, the cuts of the etched pattern are created.

In the case where a line screen is provided in the bottom of the cuts 4, said screen is obtained after the creation of the etched pattern.

Figure 3:
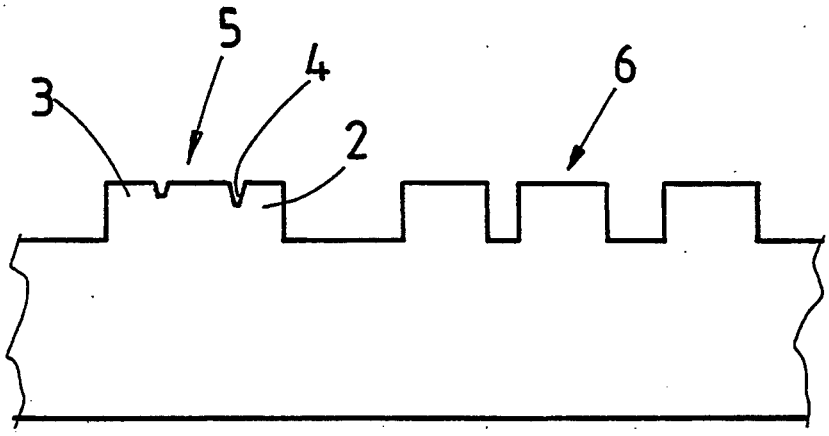
FIG. 3 represents a hybrid plate, with a region corresponding to a plate according to FIG. 1 and another region acting according to the letterpress process.

As illustrated in FIG. 3, it is also possible to envisage having a hybrid printing plate with a region 5 which includes the relief printing part 2, the printing surface 3 of which is furnished with cuts 4 defining the etched pattern, and a region 6 corresponding to a conventional letterpress plate having several relief printing parts with a smooth surface. In this case, the region 5 is inked with optically variable ink and the region 6 with normal ink, both without wiping.

In this manner, a printing plate is obtained with which it is easily possible to print one or more security patterns distributed over the printing of a security paper which includes a security background and a principal pattern; in general, one is limited to one security region per impression.

The printing plate according to the invention is not limited to use with special inks, but may obviously be used with any type of ink in order to create, in a single pass and with the same ink, a uniform background on which a raised pattern is arranged.

Such a three-dimensional relief pattern, having the appearance of intaglio printing and projecting from a uniform inked background in the same color, makes it difficult to be able to falsify it. In addition, if optically variable ink is used, the two-color effect is more pronounced on account of the fact that the reliefs of the drawing, having facets of various orientations which consequently give the appearance of various colors depending on said orientations, are seen at the same angle of sight.

The printing surface outside the relief pattern may, as mentioned, be smooth and uniform. However, the security effect is reinforced if this printing surface has a grainy structure and is especially treated according to the autotype process, known per se, in order to produce a screen. The advantages of such a halftone background are a better attraction of the ink and an increase in the complexity of the security pattern.

By preferably using optically variable ink, the two-color effect over the entire printing surface is more pronounced because the grainy structure and, respectively, the screen themselves includes reflection facets of various orientations which produce different colors.

Such a grainy structure, in the form of a line screen, may also be provided in the bottom of the cuts which form the etched pattern on the printing plate, and this is so independently of whether or not the printing surface has a grainy structure.

We claim:

1. A printing plate having at least one relief printing part (2) intended to be inked over its entire surface, said relief printing part (2) including a raised printing surface (3) for printing a first uniform inking pattern, and means on said raised printing surface having at least one etched recessed pattern having a bottom and composed of intaglio cuts (4) intended to be filled with the same ink as that serving for the inking of the raised printing surface (3) for printing a second pattern superimposed on said first pattern.

2. The printing plate as claimed in claim 1, wherein at least part of the surface (3) of the relief printing part includes a grainy structure (3*a*) composed of evenly distributed screen depressions.

3. The printing plate as claimed in claim 2, wherein the cuts (4) are deeper than the depressions of the grainy structure (3*a*).

4. The printing plate as claimed in claim 3, wherein the depressions of the grainy structure (3*a*) have a depth lying between 5 and 30 μm and wherein the cuts (4) of the etched pattern have a depth lying between 20 and 80 μm.

5. The printing plate as claimed in claim 1, wherein the height of the at least one relief printing part (2) lies between 200 μm and 1000 μm.

6. The printing plate as claimed in claim 1, wherein the bottom (4*a*) of the etched pattern (4) has a line screen.

7. The printing plate as claimed in claim 1, further comprising at least one additional relief printing part having a smooth uniform surface.

8. The printing plate as claimed in claim 1, in combination with an optically variable ink.

9. The printing plate as claimed in claim 1 wherein the raised printing surface (3) outside the etched recessed pattern has screen dots.

* * * * *